United States Patent [19]

McPherson et al.

[11] Patent Number: 5,045,044

[45] Date of Patent: Sep. 3, 1991

[54] METHOD AND DEVICE FOR FOLDING A PAPER WEB

[75] Inventors: Malcolm McPherson, Poole-Dorset, United Kingdom; Reinhold Ernest, Stadtbergen, Fed. Rep. of Germany

[73] Assignee: Grafotec Kotterer GmbH, Diedorf, Fed. Rep. of Germany

[21] Appl. No.: 566,306

[22] Filed: Aug. 13, 1990

Related U.S. Application Data

[63] Continuation of Ser. No. 259,736, Oct. 19, 1988, abandoned.

[30] Foreign Application Priority Data

Oct. 23, 1987 [DE] Fed. Rep. of Germany ..... 3735856
Nov. 26, 1987 [DE] Fed. Rep. of Germany ..... 3740046

[51] Int. Cl.[5] ..... B31B 1/36; B31B 1/62

[52] U.S. Cl. ..... 493/328; 493/418; 493/450

[58] Field of Search ..... 493/110, 151, 220, 329, 493/396, 401, 403, 418, 450, 328; 118/302; 156/547-549, 551

[56] References Cited

U.S. PATENT DOCUMENTS

| | | | |
|---|---|---|---|
| 2,847,196 | 8/1958 | Franklin et al. | 118/302 |
| 3,134,706 | 5/1964 | Alexander | 156/357 |
| 3,179,341 | 4/1965 | Ploj et al. | 118/302 |
| 3,530,774 | 9/1970 | Booth | 493/220 |
| 3,590,775 | 7/1971 | Barr | 118/302 |
| 3,808,088 | 4/1974 | Knechtges et al. | 156/291 X |
| 3,821,055 | 6/1974 | Fairbanks et al. | 156/291 X |
| 4,141,544 | 2/1979 | Birkenmayer | 493/403 |
| 4,313,899 | 2/1982 | Hain | 493/329 |

OTHER PUBLICATIONS

IBM Technical Disclosure Bulletin, vol. 17, No. 4, pp. 1098-1099, Sep. 1974.

*Primary Examiner*—Frederick R. Schmidt
*Assistant Examiner*—Jack W. Lavinder
*Attorney, Agent, or Firm*—Jones, Tullar & Cooper

[57] ABSTRACT

A method for folding a paper web in which a liquid folding adjuvant is applied along a folding line so that an improved fold is produced which is sharper if the liquid folding adjuvant is heated, preferably in a continuous flow heater, to a temperature of the order of 30° C. to 60° C. dependent on the type of paper being processed.

1 Claim, 1 Drawing Sheet

METHOD AND DEVICE FOR FOLDING A PAPER WEB

This is a continuation of co-pending application Ser. No. 07/259,736 filed on Oct. 19, 1988 now abandoned.

CROSS REFERENCE TO RELATED APPLICATION

This application discloses subject matter in common with allowed application, Ser. No. 07/247,341, and application, Ser. No. 07/509,235.

BACKGROUND OF THE INVENTION

The invention relates to a method and a device for folding a paper web onto which a liquid folding adjuvant is applied prior to the folding operation.

The liquid adjuvant applied to aid folding is intended to soften the paper fibers so that the folds are made in a highly accurate manner with a sharp edge with the result that when the folded products are stacked the stack only has a comparatively low height without any substantial extra bulk at the spine or fold of the products. There has already been a proposal to apply cold water taken from the public water supply as a means of aiding folding. However, it has become clear from experience that cold water taken from the piped water supply does not lead to the desired effect more especially in the case of certain problematical papers such as printed and/or sized papers. Furthermore attempts have been made in the past to enhance the effect by the addition to the liquid of chemical additives. However there is then the danger that the paper and/or the ink will be excessively affected by the added chemicals, this leading to a tendency to crumble and/or damage of the printed image. The amount of the added chemicals is therefore very limited and this is a further reason for it not being possible to achieve the desired effect in all cases. Furthermore the amount of added complexity in the equipment may in itself prove prohibitive.

SUMMARY OF THE PRESENT INVENTION

Taking this state of the art as a starting point one object of the present invention is to so improve on a method of the initially mentioned type that without involving added complexity a very much enhanced effect of the liquid folding adjuvant is achieved without there being any danger of crumbling of the paper or of other forms of damage.

Yet a further aim of the invention is to create a simple device for performing the method in accordance with the invention.

In order to achieve these or other aims appearing from the present specification, claims and drawings the liquid folding adjuvant is heated to a temperature above the normal room temperature.

Owing to the raised temperature of the liquid folding adjuvant it is usually sufficient to employ pure water. There is therefore no further expense owing to the necessity for chemical additives. The temperature required is dependent on the type of paper being processed. In the case of softer types of paper such as newsprint it is sufficient to heat the water only to a temperature of the order of 30° C. In the case of hard paper the necessary temperature may amount to around 60° C. If in particularly problematical cases the addition of chemicals should be necessary as well, the amount added may be kept low owing to the raised temperature within close limits so that there are no disadvantageous effects on the product. A further advantage of the invention is that the warmed water used as the liquid folding adjuvant may be advantageously also used for flushing out a glue applying system which is generally provided in the equipment for applying glue to the lower of two superposed webs at the fold line in the form of a streak, the raised temperature of the water meaning that there is a particularly reliable removal of residues of glue. A further result of this operation is that serviceability is enhanced.

The method of the invention may be performed with simple means and in an advantageous manner. For this purpose it is simply a question of having a liquid folding adjuvant duct leading to at least one feed head and having a heating device, preferably in the form of a continuous flow heater. The continuous flow heater may conveniently be placed downstream from any mixing device for the addition of chemicals so that the possible addition of chemicals does not lead to any change in the temperature.

Since normally only glue or only a liquid folding adjuvant in the form of water or the like is applied at a time there is the practical advantage that one and the same feed head may be employed. In order to effect flushing of the glue system with warmed water it is simply possible to provide a multiway valve controlling a bypass between the duct for the liquid folding adjuvant and the duct for the glue.

Further advantageous features and convenient developments of the invention will be seen from the following account of one working example of the invention with reference to the drawing and the claims.

DETAILED DESCRIPTION OF THE INVENTION

Figure 1:
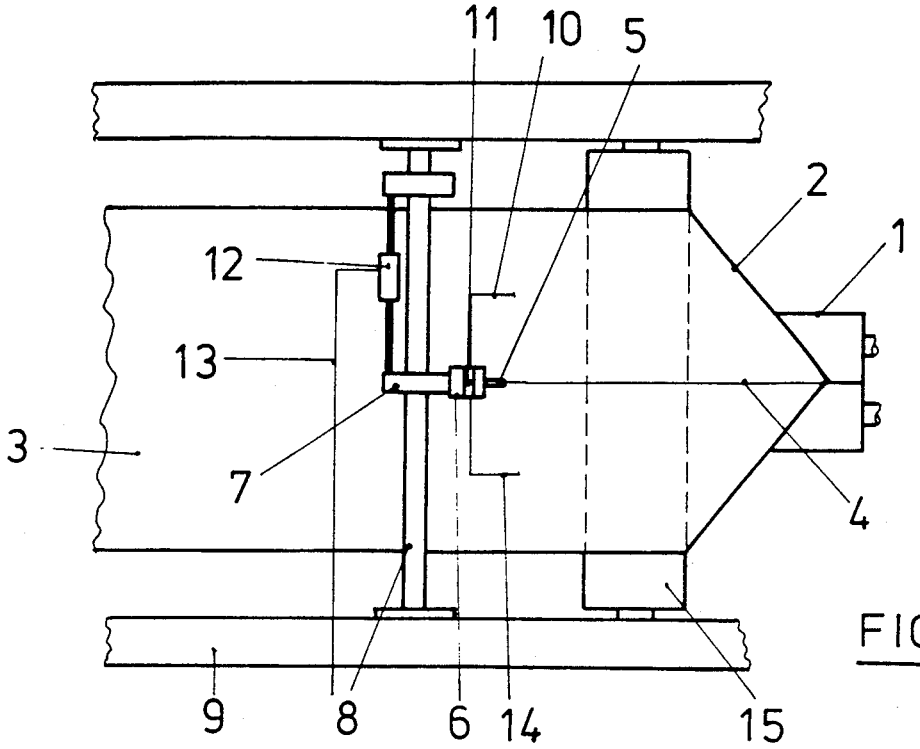
FIG. 1 is a diagrammatic plan view of a longitudinal folding device placed on the intake side of a folder.

The longitudinal folding device shown in FIG. 1 consists of a fold funnel 2 placed over two fold rolls 1 and via the funnel 2 a printed paper web 3 or a plurality of such webs is or are drawn on for further processing. After a longitudinal folding operation the web or the set of webs is cut up into sections by means of a transverse cutting device so that the sections may then undergo further folding. In order to facilitate the longitudinal folding operation to be performed by the fold funnel 2 the paper web 3 shown in FIG. 1 has a liquid folding adjuvant applied to it along a fold line aligned with the nip of the fold rolls 1 and the nose of the fold funnel 2. This liquid folding adjuvant is applied in the form of a streak of liquid as indicated at 4. The liquid folding adjuvant causes the paper material to soften along the fold line so that a precise and knife-edge fold may be produced.

The liquid folding adjuvant applied in the form of the liquid streak 4 may consist of warmed tap water. The water temperature used will depend on the type of paper being processed. In the case of absorbent papers, such as newsprint or the like, a temperature as low as 30° C. may well prove sufficient. In the case of problematical papers a higher temperature of the order of approximately 60° C. leads to excellent results. If a fixed temperature setting is desired which will be applicable for all cases, then a value of approximately 50° C. will be acceptable. If the warming of the liquid folding adjuvant is not sufficient in some stubborn cases, the liquid folding adjuvant may be mixed with chemical additives. Owing to the temperature of the liquid folding adjuvant however only very small amounts of such chemicals are required. In most cases the raised temperature will mean that normal tap water from the public supply is all that is required.

The liquid folding adjuvant may be applied by means of an injection needle or, as in the present case, by means of a nozzle 5 without making contact. The nozzle is mounted on a feed head 6, which is held in place by means of an associated holder 7 attaching it to a crosspiece 8, which is secured to the walls 9 of the frame of the top part of the folding device or the printing press. The feed head 6 is provided with suitable supply ducts 10 and suitable valve members 11 for turning the nozzle 5 on and off. The position of the nozzle 5 may be set by sliding the holder 7 along the crosspiece 8. In simple cases this setting may be manual. In the embodiment of the invention illustrated however there is a remote controlled setting device 12 which is operated via a signal wire 13 leading to the operator's console. In the same manner it is also possible for the switching valves 11 of the feed head 6 to be remote controlled via a control line 14. The nozzle 5 operates without making contact, that is to say with a clearance between it and the web 3 and accordingly there is no danger of its fouling up or becoming blocked.

The feed head 6 with the nozzle 5 for the application of the liquid folding adjuvant in a streak 4 is located in the vicinity of the point at which the respective web 3 runs onto a bend roll 15 placed over the fold funnel 2, this leading to a taut condition of the web and to a constant distance between the web 3 and the nozzle 5. Owing to the contact-free application of the liquid folding adjuvant from the nozzle it would also readily be possible as well to tolerate a certain amount of flutter of the web.

In those cases in which two or more webs are supplied to the fold funnel 2 and are to be adhered to each other in the vicinity of the fold line, glue is applied to the respectively lower web along the fold line. This glue may also be warmed to facilitate the folding operation. The uppermost web, which does not get any glue applied thereto, still receives an application of liquid folding adjuvant in the form of water warmed to a greater or less extent. Since for each web only glue or only liquid folding adjuvant is required, the application of glue or, in the present case, of warmed water, may take place using one and the same feed head 6, which dependent on its mode of operation is supplied with glue or, respectively, water. Such a feed head is, as will best be seen from FIG. 2, provided with two parallel inlet ports.

The number of the feed heads 6 mounted on each crosspiece 8 and associated with a respective web 3, will depend on the number of the streaks of liquid folding adjuvant and, respectively, glue. In the example of the invention shown in FIG. 1 only one feed head 6 is shown in order to simplify the figure, such head being needed for the application of the liquid folding adjuvant 4. If further feed heads 6 are mounted in the crosspiece 8, they may be put out of operation as need may be and not removed.

Figure 2:
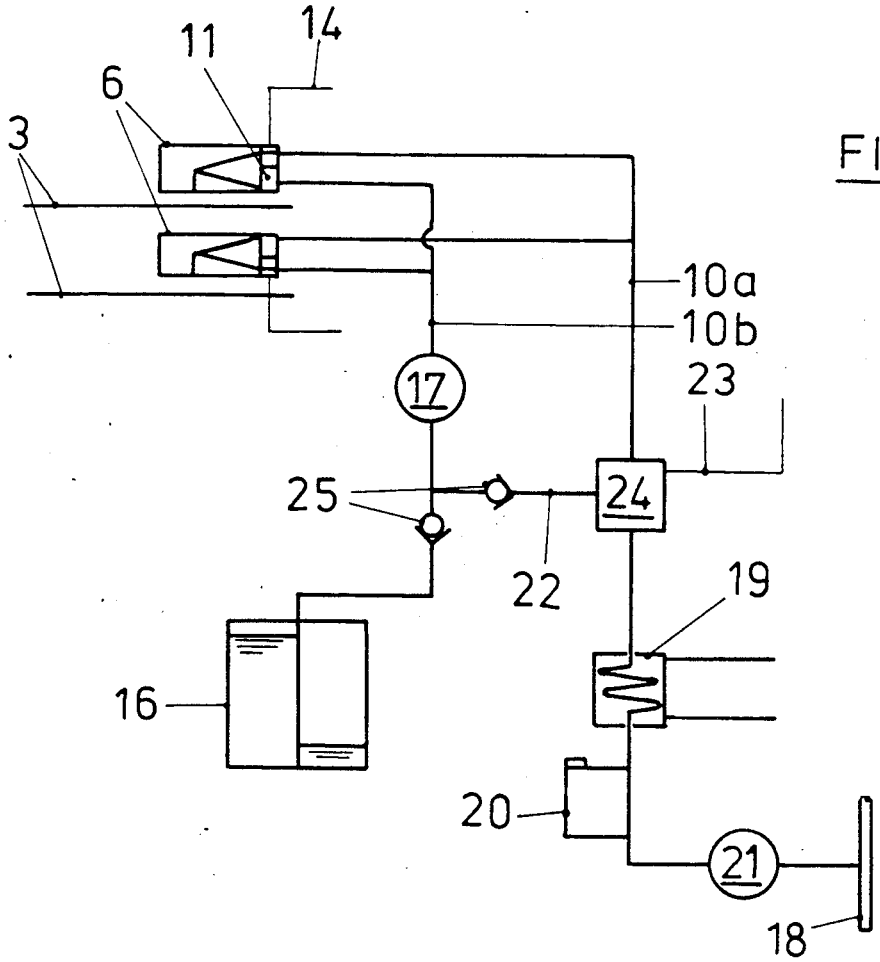
FIG. 2 is a block circuit diagram of a device for aiding in the folding operation.

In the case of the block diagram shown in FIG. 2 two feed head 6 are indicated, which are to serve two superposed webs 3. Each feed or application head 6 is provided with two inlet ports for a liquid folding adjuvant duct 10*a* and a glue duct 10*b*, of which only one of the ducts is used at a time for the supply of the liquid folding adjuvant or, respectively, the glue. In the operational mode shown in FIG. 2 the lower feed head 6 is to be supplied with glue and the upper feed head 6 is to be fed with liquid folding adjuvant in the form of warmed water. The feed heads 6 are, as mentioned above, provided with a fitted switching valve 11 which in the present case is in the form of a solenoid valve operated via the control wire 14, such valve closing one duct and opening the other as may be desired.

The glue supply duct 10*b* provided with a fine duct leading to each feed head 6 is supplied from a tank 16 provided with two chambers which are alternately emptied. In order to avoid stoppages at the nozzle which serves simultaneously for the application of glue and liquid folding adjuvant and is therefore very fine, there is a filter device 17 arranged on the glue supply duct 10*b*. If heating of the glue, which simultaneously serves as a liquid folding adjuvant, is required in the same manner as the heating of the regular liquid folding adjuvant, it is possible to provide a heating device placed upstream or downstream from the filter device 17 or placed therein.

The supply duct 10*a* for the liquid folding adjuvant which also has a fine branch duct leading to each feed head 6, may be supplied with tap water, that is to say from a tap water pipe 18. For heating up the liquid folding adjuvant to a desired temperature in a range between approximately 30° C. and 60° C. the liquid folding adjuvant duct 10*a* extends through a continuous flow heater 19. Upstream from the continuous flow heater 19 there is in the present case a mixing device 20, by means of which the liquid folding adjuvant may be mixed with chemicals in a continuous manner. Such chemicals intensify the fold promoting action. For filtering off dirt it is possible to have a filter device 21 arranged on the intake side, that is to say in the vicinity of the branch from the tap water supply pipe.

In order to flush out the glue feeding device with warm water the liquid folding adjuvant supply duct 10*a* and the glue supply duct 10*b* are connected with each other by a bypass duct 22, which branches off at a point downstream from the continuous heater 19 from the liquid folding adjuvant supply duct 10*a* and opens into the glue supply duct 10*b* in the vicinity of the outlet port of the tank 16. At the point of branching of the bypass duct 22 from the liquid folding adjuvant supply duct 10*a* there is a multiway valve 24 able to be remotely controlled via a control line 23 so that by means of such valve the bypass duct 22 may be opened or, respectively, closed as an alternative to the downstream part of the liquid folding adjuvant supply duct 10*b*. In order to avoid undesired passage of water into the glue tank 16 and, respectively, of glue into the liquid folding adjuvant supply duct 10*a* there are check valves, placed back to back, in the glue duct 10*b* upstream from the port of the bypass duct 22 and in the bypass duct 22, such valves 25 being so arranged that the check valve arranged in the bypass duct 22 opens when acted upon by the pressure of the water and closes when acted upon by the pressure of the glue and the check valve arranged on the glue supply duct 10*b* opens when acted upon by the pressure of the glue and closes under the pressure of the water. By flushing out the entire glue feed system it is possible to reliably avoid the formation of incrustations of material, which might otherwise be formed if the device is left standing for prolonged periods of time.

In the case of short idle periods it is generally sufficient, in order to avoid operational trouble conditions, to flush out the nozzles 5. For this purpose the bypass duct is shut down and the switching valve 11, which is in the form of a multiway solenoid valve, is so operated that on stopping the feed of web the glue supply duct 10*b* is interrupted and the liquid folding adjuvant supply duct 10*a* is opened so that even if the bypass duct 22 is interrupted flushing of the nozzles 5 will take place using liquid folding adjuvant under pressure. When the bypass duct 22 is in operation the valve 11 fitted in each feed head is so operated that the duct with the liquid folding adjuvant under pressure is opened and the other supply duct is interrupted.

The flushing of the nozzles 5 and, respectively, of the glue applying system may be commenced as soon as the speed of the web has fallen to a value below about one third of the normal web speed, since during the time the web is run out of the press only waste will be produced.

The switching valves 11 and 24 designed in the form of multiway solenoid valves may be controlled via the associated control wires 14 and, respectively, control lines from a computer processing different pairs of operational parameters and/or controlled by hand.

We claim:

1. In a method of producing at least one fold in a plurality of superposed layers of paper webs, comprising the steps of:

continually heating a liquid folding adjuvant, comprising essentially tap water, to a temperature in a range extending from essentially 30° C. to 60° C.;

applying the heated tap water in the form of a thin jet to the top layer of said superposed layers of paper webs along a fold line;

folding the web on which the heated tap water is applied along the fold line;

applying glue from a glue applying system in the form of a stream to the layers of said superposed layers of paper webs below said top layer; and flushing the glue applying system with heated water.

* * * * *